US009070358B2

(12) United States Patent
Den Brinker et al.

(10) Patent No.: US 9,070,358 B2
(45) Date of Patent: Jun. 30, 2015

(54) PARAMETRIC ENCODING AND DECODING

(75) Inventors: Albertus Cornelis Den Brinker, Eindhoven (NL); Erik Gosuinus Petrus Schuijers, Eindhoven (NL); Arnoldus Werner Johanees Oomen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 566 days.

(21) Appl. No.: 13/505,758

(22) PCT Filed: Nov. 5, 2010

(86) PCT No.: PCT/IB2010/055025

§ 371 (c)(1), (2), (4) Date: May 3, 2012

(87) PCT Pub. No.: WO2011/058484

PCT Pub. Date: May 19, 2011

(65) Prior Publication Data

US 2012/0224702 A1 Sep. 6, 2012

(30) Foreign Application Priority Data

Nov. 12, 2009 (EP) ..... 09175771

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
None
See application file for complete search history.

(56) References Cited

U.S. PATENT DOCUMENTS

| | | | | |
|---|---|---|---|---|
| 2005/0074127 | A1 | 4/2005 | Herre et al. | |
| 2006/0233380 | A1* | 10/2006 | Holzer et al. | 381/23 |
| 2007/0189426 | A1* | 8/2007 | Kim et al. | 375/343 |
| 2008/0255859 | A1* | 10/2008 | Jung et al. | 704/500 |
| 2008/0262853 | A1 | 10/2008 | Jung et al. | |
| 2009/0006105 | A1 | 1/2009 | Oh et al. | |
| 2009/0043591 | A1* | 2/2009 | Breebaart et al. | 704/500 |
| 2009/0110203 | A1 | 4/2009 | Taleb | |

FOREIGN PATENT DOCUMENTS

EP 1735774 B1 12/2006

OTHER PUBLICATIONS

Hilbert et al: "The MPEG Surround Audio Coding Standard"; IEEE Signal Processing Magazine, Vol. 148, Jan. 2009, pp. 1-5.

(Continued)

*Primary Examiner* — Duc Nguyen
*Assistant Examiner* — Assad Mohammed

(57) ABSTRACT

An encoder for a multi-channel audio signal which comprises a down-mixer (201, 203, 205) for generating a down-mix as a combination of at least a first and second channel signal weighted by respectively a first and second weight with different amplitudes for at least some time-frequency intervals. Furthermore, a circuit (201, 203, 209) generates up-mix parametric data characterizing a relationship between the channel signals as well as characterizing the weights. A circuit generates weight estimates for the encoder weights from the up-mix parametric data; and comprises an up-mixer (407) which recreates the multi channel audio signal by up-mixing the down-mix in response to the up-mix parametric data, the first weight estimate and the second weight estimate. The up-mixing is dependent on the amplitude of at least one of the weight estimate(s).

15 Claims, 4 Drawing Sheets

(56) References Cited

OTHER PUBLICATIONS

Kim et al"Enhanced Stereo Coding With Phase Parameters for MPEG Unified Speech and Audio Coding"; Audio Engineering Society Convention Paper 7875, Oct. 2009, pp. 1-7.
Hyan et al: "Robust Interchannel Correlation (ICC) Estimation Using Constant Interchannel Time Difference (ICTD) Compensation"; Audio Engineering Society Convention Paper 7934, Oct. 2009, pp. 512-517.
Thompson et al: "An Active Multichannel Downmix Enhancement for Minimizing Spatial and Spectral Distortions"; Audio Engineering Society Convention Paper 7913, Oct. 2009, pp. 1160-1166.
Samsudin et al: "A Subband Domain Downmicxing Scheme for Parametric Stereo Encoder"; Audio Engineering Society Convention Paper 6815, May 2006, pp. 1157-1162.
Lapierre et al: "On Improving Parametric Stereo Audio Coding"; Audio Engineering Society Convention Paper 6804, May 2006, pp. 1-9.

* cited by examiner

PARAMETRIC ENCODING AND DECODING

FIELD OF THE INVENTION

The invention relates to parametric encoding and decoding and in particular to parametric encoding and decoding of multi-channel signals using a down-mix and parametric up-mix data.

BACKGROUND OF THE INVENTION

Digital encoding of various source signals has become increasingly important over the last decades as digital signal representation and communication increasingly has replaced analogue representation and communication. For example, distribution of media content, such as video and music, is increasingly based on digital content encoding.

Encoding of multi-channel signals may be performed by down-mixing of the multi-channel signal to fewer channels and the encoding and transmission of these. For example, a stereo signal may be down-mixed to a mono signal which is then encoded. In parametric multi-channel encoding, parametric data is furthermore generated which supports an up-mixing of the down-mix to recreate (approximations) of the original multi-channel signal. Examples of multi-channel systems that use down-mixing/up-mixing and associated parametric data include the technique known as Parametric Stereo (PS) standard and its extension to multi-channel parametric coding (e.g., MPEG Surround: MPS).

In its simplest form, the down-mixing of a stereo signal to a mono signal may simply be performed by generating the average of the two stereo channels i.e. by simply generating the mid or sum signal. This mono signal may then be distributed and may further be used directly as a mono-signal. In encoding approaches such as used by Parametric stereo, stereo cues are provided in addition to the down-mix signal. Specifically, inter-channel level differences, time- or phase-differences and coherence or correlation parameters are determined per time-frequency tile (which typically corresponds to a Bark or ERB band division of the frequency axis and a fixed uniform segmentation of the time axis). This data is typically distributed together with the down-mix signal and allows an accurate recreation of the original stereo signal to be made by an up-mixing which is dependent on the parameters.

However, it is well-known that creating the mid signal typically results in somewhat dull signals, i.e., with reduced brightness/high-frequency content. The reason is that for typical audio signals, the different channels tend to be fairly correlated for low-frequencies but not for higher frequencies. Direct summation of the two stereo channels effectively suppresses the non-aligned signal components. Indeed, for frequency subbands wherein the left and right signals are completely out of phase, the resulting mid signal is zero.

A solution which has been proposed is to use phase alignment of the channels before the summation is performed. Thus, ideally the left and right signals are compensated for any phase difference in the frequency domain (corresponding to time difference in the time domain) before being added together. However, such an approach tends to be complex and may introduce an algorithmic delay. Also, in practice, the approach tends to not provide optimal quality. E.g. if the inter-channel phase-difference is measured, there is an ambiguity in whether to align the phase of the left channel to the right channel or vice versa. Also trying to shift the phase of both channels equally leads to ambiguity. Further, the phase difference is numerically ill-conditioned when the correlation is low thereby resulting in a less accurate and robust system. Overall these issues tend to lead to perceptible artifacts when creating a down-mix by phase-alignment. Typically, modulations on tonal components result from the approach.

As a consequence most practical systems tend to use a so-called passive down-mix generated simply as the mean of the left and right signals. Unfortunately, the passive down-mixing also has some associated disadvantages. One of these is that the acoustic energy can be substantially reduced and even completely lost for out of phase signals. A proposed method for addressing this is to use a so called active down-mixing where the down-mix is rescaled to have the same energy as the original signals. Another proposed solution is to provide a decoder-side energy compensation. However, such compensations tend to be on a rather global level and do not discriminate between tonal components (where compensation is necessary) and noise (where it is not). Furthermore, in both passive and active down-mix approaches, problems occur for signals that approach being out of phase. Indeed, out-of-phase components are completely absent in the down-mix signal.

Hence, an improved system for multi-channel parametric encoding/decoding would be advantageous and in particular a system allowing increased flexibility, facilitated operation, facilitated implementation, reduced complexity, improved robustness, improved encoding of out of phase signal components, reduced data rate versus quality ratio and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a decoder for generating a multi-channel audio signal, the decoder comprising: a first receiver for receiving a down-mix being a combination of at least a first channel signal weighted by a first weight and a second channel signal weighted by a second weight, the first weight and the second weight having different amplitudes for at least some time-frequency intervals; a second receiver for receiving up-mix parametric data characterizing a relationship between the first channel signal and the second channel signal; a circuit for generating a first weight estimate for the first weight and a second weight estimate for the second weight from the up-mix parametric data; and an up-mixer for generating the multi-channel audio signal by up-mixing the down-mix in response to the up-mix parametric data, the first weight estimate and the second weight estimate, the up-mixing being dependent on an amplitude of at least one of the first weight estimate and the second weight estimate.

The invention may allow improved and/or facilitated operation in many scenarios. The approach may typically mitigate out-of-phase problems and/or disadvantages of phase alignment encoding. The approach may often allow improved audio quality without necessitating an increased data rate. A more robust encoding/decoding system may often be achieved and especially the encoding/decoding may be less sensitive to specific signal conditions. The approach may allow low complexity implementation and/or have a low computational resource requirement.

The processing may be subband based. The encoding and decoding may be performed in frequency subbands and in time intervals. In particular, the first weight and the second weight may be provided for each frequency subband and for each (time) segment, together with a down-mix signal value.

The down-mix may be generated by individually in each subband combining the frequency subband values of the first and second channel signals weighted by the weights for the subband. The weights (and thus weight estimates) for a subband have different amplitudes (and thus energies) for at least some values of the first and second channel signals. Each time-frequency interval may specifically correspond to an encoding/decoding time segment and frequency subband.

The up-mix parametric data comprises parameters that may be used to generate an up-mix corresponding to the original down-mixed multi-channel signal from the down-mix. The up-mix parametric data may specifically comprise Interchannel Level Difference (ILD), Interchannel Coherence/Correlation (IC/ICC), Interchannel Phase Difference (IPD) and/or Interchannel Time Difference (ITD) parameters. The parameters may be provided for frequency subbands and with a suitable update interval. In particular, a parameter set may be provided for each of a plurality of frequency bands for each encoding/decoding time segment. The frequency bands and/or time segments used for the parametric data may be identical to those used for the down-mix but need not be. For example, the same frequency subbands may be used for lower frequencies but not for higher frequencies. Thus, the time-frequency resolution for the first and second weights and the parameters of the up-mix parametric data need not be identical.

One of the first and second weights (and thus the corresponding weight estimates) may for some signal values be zero in one subband. The combination of the first and second channel signals may be a linear combination such as specifically a linear summation with each signal being scaled by the corresponding weight prior to summation.

The multi-channel signal comprises two or more channels. Specifically, the multi-channel signal may be a two-channel (stereo) signal.

The approach may in particular mitigate out-of-phase problems to provide a more robust system while at the same time maintaining low complexity and low data rate. Specifically, the approach may allow different weights (with different amplitudes) to be determined without requiring additional data to be sent. Thus, an improved audio quality may be achieved without necessitating an increased data rate.

The determination of the first and/or second weight estimates may use the same approach that is (assumed to be) used for determining the first and/or second weights in the encoder. In many embodiments, one or both weights/weight estimates may be determined based on an assumed function for determining the weight/weight estimate from the parameters of the up-mix parametric data.

The decoder may not have explicit information of the exact characteristics of the received signal but may simply operate by assuming that the down-mix is a combination of at least a first channel signal weighted by a first weight and a second channel signal weighted by a second weight where the first weight and the second weight have different amplitudes for at least some time-frequency intervals. A time-frequency interval may correspond to a time interval, a frequency interval or the combination of a time interval and a frequency interval, such as for example a frequency subband in a time segment.

In accordance with an optional feature of the invention, the circuit is arranged to generate the first weight estimate and the second weight estimate with different relationships to at least some parameters of the parametric data for the at least some time-frequency intervals.

This may allow an improved encoding/decoding system and may in particular mitigate out-of-phase problems to provide a more robust system. The functions for determining the weight estimates from parameters may thus be different for the two weights such that the same parameters will result in weight estimates with different amplitudes.

The encoder may accordingly be arranged to determine the first weight and the second weight to have different relationships to at least some parameters of the parametric data for the at least some time-frequency intervals.

A time-frequency interval may correspond to a time interval, a frequency interval or the combination of a time interval and a frequency interval, such as for example a frequency subband in a time segment.

In accordance with an optional feature of the invention, the up-mixer is arranged to determine at least one of the first weight estimate and the second weight estimate as a function of an energy parameter of the up-mix parametric data, the energy parameter being indicative of a relative energy characteristic for the first channel signal and the second channel signal.

This may provide improved performance and/or facilitated operation and/or implementation. Energy considerations may be particularly relevant for determination of suitable weights, and these may accordingly be more suitably represented and correlated with the energy parameters of the up-mix parametric data. Thus, the use of energy parameters to determine weights/weight estimates allows an efficient communication of information allowing weights/weight estimates with different amplitudes to be determined. In particular, the use of energy parameters to determine weights/weight estimates allows an efficient determination of the amplitude of the weights rather than merely the phase of weights. Energy parameters may specifically provide information of the energy (or equivalently power) characteristics of either the first channel signal, the second channel signal, of a difference there between or of an energy of a combined signal (such as a cross-power characteristic).

In accordance with an optional feature of the invention, the energy parameter is at least one of: an Interchannel Intensity Difference, IID, parameter; an Interchannel Level Difference, ILD, parameter; and an Interchannel Coherence/Correlation, IC/ICC, parameter.

This may provide particularly advantageous performance and may provide improved backwards compatibility.

In accordance with an optional feature of the invention, the up-mix parametric data comprises an accuracy indication for a relationship between the first weight and the second weight and the up-mix parametric data, and the decoder is arranged to generate at least one of the first weight estimate and the second weight estimate in response to the accuracy indication.

This may provide improved performance in many scenarios and may in particular allow an improved determination of more accurate weight estimates for different signal conditions.

The accuracy indication may be indicative of an accuracy that can be obtained for a weight estimate when calculating this from the parametric data. The accuracy indication may specifically indicate whether the achievable accuracy meets an accuracy criterion or not. E.g. the accuracy indication may be a binary indication simply indicating whether the parametric data can be used or not. The accuracy indication may comprise an individual value for each subband or may comprise one or more indications applicable to a plurality of or even all subbands.

The decoder may be arranged to estimate the weight estimates from the parametric data only if the accuracy indication is indicative of a sufficient accuracy.

In accordance with an optional feature of the invention, at least one of the first weight and the second weight for at least one frequency interval has a finer frequency-temporal resolution than a corresponding parameter of the up-mix parametric data.

This may provide improved performance in many scenarios as more accurate weights can be used to generate the down-mix while at the same time allowing the data rate to be maintained low.

Similarly, at least one of the first weight estimate and the second weight estimate for at least one frequency interval may have a finer frequency-temporal resolution than a corresponding parameter of the up-mix parametric data.

The corresponding parameter is the parameter that includes the same time frequency interval. In many embodiments, the decoder may proceed to generate the estimate for the first and/or second weight based on the corresponding parameter. Thus, although the parameter may represent signal characteristics over a larger time and/or frequency interval it may still be used as an approximation for the time and/or frequency interval of the weight.

In accordance with an optional feature of the invention, the up-mixer is arranged to generate an Overall Phase Difference value for the in response to the parametric data and to perform the up-mixing in response to the Overall Phase Difference value, the Overall Phase Difference value being dependent on the first weight estimate and the second weight estimate.

This may allow an efficient decoding with high quality. It may in some scenarios provide improved backwards compatibility. The OPD is individually dependent on both the first and second weight estimates (including the amplitudes thereof) and may specifically be defined as a function of the weights, i.e. OPD=f($w_1$, $w_2$).

The up-mix may for example be generated substantially as:

$$\begin{bmatrix} l \\ r \end{bmatrix} = \begin{bmatrix} c_1 \cdot \cos(\alpha+\beta) \cdot e^{jopd} & c_1 \cdot \sin(\alpha+\beta) \cdot e^{jopd} \\ c_2 \cdot \cos(-\alpha+\beta) \cdot e^{j(opd-ipd)} & c_2 \cdot \sin(-\alpha+\beta) \cdot e^{j(opd-ipd)} \end{bmatrix} \begin{bmatrix} s \\ s_d \end{bmatrix},$$

where s is the down-mix signal and $s_d$ is a decoder generated decorrelated signal for the down-mix signal. $c_1$ and $c_2$ are gain parameters that are used to reinstate the correct level difference between the left and right output channels and α and β are values that can be generated from the up-mix parametric data.

The OPD value may e.g. be generated substantially as:

$$opd = \arctan\left\{\frac{-w_{1i} \cdot iid + w_{2r} \cdot icc \cdot \sin(ipd) \cdot \sqrt{iid} - w_{2i} \cdot icc \cdot \cos(ipd) \cdot \sqrt{iid}}{w_{1r} \cdot iid + w_{2r} \cdot icc \cdot \cos(ipd) \cdot \sqrt{iid} + w_{2i} \cdot icc \cdot \sin(ipd) \cdot \sqrt{iid}}\right\},$$

or e.g. substantially as:

$$opd = \arctan\left\{\frac{-w_{1i} \cdot iid + w_{2r} \cdot \sin(ipd) \cdot \sqrt{iid} - w_{2i} \cdot \cos(ipd) \cdot \sqrt{iid}}{w_{1r} \cdot iid + w_{2r} \cdot \cos(ipd) \cdot \sqrt{iid} + w_{2i} \cdot \sin(ipd) \cdot \sqrt{iid}}\right\},$$

where $w_1$ and $w_2$ are the first and second weights respectively and the down-mix signal is generated by $s=w_1 \cdot l+w_2 \cdot r$.

In accordance with an optional feature of the invention, the up-mixing is independent of the amplitude of the at least one of the first weight estimate and the second weight estimate except for the Overall Phase Difference value.

This may allow improved performance and/or operation.

In accordance with an optional feature of the invention, the up-mixer is arranged to: generate a decorrelated signal from the down-mix, the decorrelated signal being decorrelated with the down-mix; up-mix the dowmix by applying a matrix multiplication to the down-mix and the decorrelated signal wherein coefficients of the matrix multiplication are dependent on the first weight estimate and the second weight estimate.

This may allow an efficient decoding with high quality. It may in some scenarios provide improved backwards compatibility.

The matrix multiplication may include a prediction coefficient representing a prediction of a difference signal from the down-mix signal. The prediction coefficient may be determined from the weights. The matrix multiplication may include a decorrelation scaling factor representing a contribution to a difference signal from the decorrelation signal. The decorrelation scaling factor may be determined from the weights.

The coefficients of the matrix multiplication may be determined from the estimated weights. The different coefficients may have different dependencies on the first and second weights and the first and second weights may affect each coefficient differently.

The up-mix may specifically be performed substantially as:

$$\begin{bmatrix} l \\ r \end{bmatrix} = \frac{1}{|w_1|^2 + |w_2|^2} \begin{bmatrix} w_1^* - \alpha \cdot w_2 & -\beta \cdot w_2 \\ w_2^* + \alpha \cdot w_1 & \beta \cdot w_1 \end{bmatrix} \begin{bmatrix} s \\ s_d \end{bmatrix},$$

where α is the prediction factor, β is the decorrelation scaling factor, s is the down-mix, $s_d$ is a decoder generated decorrelated signal, $w_1$ and $w_2$ are the first and second weights respectively and * denotes complex conjugation.

α and/or β may be determined from the estimated weights and the parametric data e.g. substantially as:

$$\alpha = \frac{(1 - iid) \cdot w_2^* \cdot w_1^* - icc \cdot \sqrt{iid} \cdot (w_2^* \cdot w_2^* \cdot \exp(j \cdot ipd) - w_1^* \cdot w_1^* \cdot \exp(-j \cdot ipd))}{|w_1|^2 \cdot iid + |w_2|^2 + 2 \cdot icc \cdot \sqrt{iid} \cdot \mathcal{R}\{w_1 \cdot w_2^* \cdot \exp(j \cdot ipd)\}},$$

$$\beta = \frac{\left(\sqrt{iid \cdot (2 \cdot |w_1|^2 \cdot |w_2|^2 + (1 - icc^2) \cdot (|w_1|^4 + |w_2|^4) - 2 \cdot icc^2 \cdot |w_1 \cdot w_2^* \cdot \exp(j \cdot ipd)|^2}\right)}{\left(|w_1|^2 \cdot iid + |w_2|^2 + 2 \cdot icc \cdot \sqrt{iid} \cdot \mathcal{R}\{w_1 \cdot w_2^* \cdot \exp(j \cdot ipd)\}\right)}.$$

In accordance with an optional feature of the invention, the up-mixer is arranged to determine the first weight estimate by: determining a first energy measure indicative of an energy of a non-phase aligned combination for the first channel signal and the second channel signal in response to the up-mix parametric data; determining a second energy measure indicative of an energy of a phase aligned combination of the first channel and the second channel in response to the up-mix parametric data; determining a first measure of the first energy measure relative to the second energy measure; determining the first weight estimate in response to the first measure.

This may provide a highly advantageous determination of the first weight estimate. The feature may provide improved performance and/or facilitated operation.

The first energy measure may be an indication of the energy of a summation of the first channel signal and the second channel signal. The second energy measure may be an indication of the energy of a coherent summation of the first channel signal and the second channel signal. The first measure may represent an indication of the degree of phase cancellation between the first channel signal and the second channel signal. The first and/or second energy measure may be any indication of an energy and may specifically relate to energy normalized measures, e.g. relative to an energy of the first and/or the second channel signal.

The first measure may for example be determined as a ratio between the first energy measure and the second energy measure. For example, the first measure may be determined substantially as:

$$r = \frac{iid + 1 + 2 \cdot \cos(ipd) \cdot icc \cdot \sqrt{iid}}{iid + 1 + 2 \cdot icc \cdot \sqrt{iid}}.$$

The first weight may be determined as a non-linear and/or monotonic function of the first measure. The second weight may e.g. be determined from the first weight, e.g. so that the sum of the amplitude of the two weights have a predetermined value. In some embodiments the generation of the first and/or second weight may include a normalization of the energy of the down-mix. For example, the weights may be scaled to result in a down-mix with substantially the same energy as the sum of the energy of the left channel signal and the energy of the right channel signal.

The weights may specifically be generated substantially as follows:

$$q = \begin{cases} 0 & r < 0.5 \\ \frac{r - 0.5}{0.75 - 0.5} & 0.5 \le r \le 0.75 \\ 1 & r > 0.75, \end{cases}$$

or $$q = r^{1/4},$$

combined with $$g_1 = 2 - q,$$

$$g_2 = q,$$

results in $$w_1 = g_1 \cdot c,$$

$$w_2 = g_2 \cdot c,$$

where c is selected to provide the desired energy normalization.

The encoder may perform the same operations and derivation of the first weight (and possibly the second weight) as described with reference to the encoder.

In accordance with an optional feature of the invention, the up-mixer is arranged to determine the first weight estimate by: for each of a plurality of pairs of predetermined values of the first weight and the second weight determining in response to the parametric data an energy measure indicative of an energy of a down-mix corresponding to the pairs of predetermined values; and determining the first weight in response to the energy measures and the pairs of predetermined values.

This may provide a highly advantageous determination of the first weight estimate. The feature may provide improved performance and/or facilitated operation.

The decoder may assume the down-mix to be a combination of a plurality of down-mixes using predetermined fixed weights with the combination being dependent on the signal energy of each down-mix. Thus, the first weight estimate (and/or the second weight estimate) may be determined to correspond to a combination of the predetermined weights where the combination of the individual predetermined weights are determined in response to the estimated energy (or equivalently power) of each of the down-mixes. The estimated energy for each down-mix may be determined on the basis of the up-mix parametric data.

Specifically, the first weight estimate may be determined by combining the pairs of predetermined values with a weighting of each pair of predetermined values being dependent on the energy measure for the pair of predetermined values.

The energy measure for a pair of predetermined values may specifically be determined substantially as:

$$r_m = \sqrt{\frac{E_m}{E_{tot}}} = \sqrt{\frac{iid + 1 + 2\Re\{M(m, 0) \cdot M^*(m, 1) \cdot icc \cdot \exp(j \cdot ipd) \cdot \sqrt{iid}\}}{4(iid + 1)}},$$

where m is an index for the pair of predetermined weights and M(m,k) represents the k'th weight of the m'th pair of predetermined weights.

In some embodiments, a bias may be introduced towards one or more of the pairs of weights. For example, the energy measure may be determined as:

$$r_m = \sqrt{\frac{E_m}{E_{tot}}} \cdot b(m) = \sqrt{\frac{iid + 1 + 2\Re\{M(m, 0) \cdot M^*(m, 1) \cdot icc \cdot \exp(j \cdot ipd) \cdot \sqrt{iid}\}}{4(iid + 1)}} \cdot b(m),$$

where b(m) is a biasing function which may introduce an additional bias for one or more of the down-mixes. The biasing function may be a function of the up-mix parametric data.

According to an aspect of the invention there is provided an encoder for generating an encoded representation of a multichannel audio signal comprising at least a first channel and a second channel, the encoder comprising: a down-mixer for generating a down-mix as a combination of at least a first channel signal of the first channel weighted by a first weight and a second channel signal of the second channel weighted by a second weight, the first weight and the second weight having different amplitudes for at least some time-frequency intervals; a circuit for generating up-mix parametric data characterizing a relationship between the first channel signal and the second channel signal, the up-mix parametric data further characterizing the first weight and the second weight; and a circuit for generating the encoded representation to include the down-mix and the up-mix parametric data.

This may provide a particularly advantageous encoding which may be compatible with the decoder described above. It will be appreciated that most of the comments provided with reference to the decoder apply equally to the encoder as appropriate.

The first and second weights may not be included in up-mix parametric data or indeed may not be communicated or distributed by the encoder. The down-mix may be encoded in accordance with any suitable encoding algorithm.

In accordance with an optional feature of the invention, the down-mixer is arranged to: determine a first energy measure indicative of an energy of a non-phase aligned combination for the first channel signal and the second channel signal; determine a second energy measure indicative of an energy of a phase aligned combination of the first channel signal and the second channel signal; determining a first measure of the first energy measure relative to the second energy measure; and determining the first weight and the second weight in response to the first measure.

This may provide a particularly advantageous encoding.

In accordance with an optional feature of the invention, the down-mixer is arranged to: for each of a plurality of pairs of predetermined values of the first weight and the second weight generating a down-mix; for each of the down-mixes determining an energy measure indicative of an energy of the down-mix; and generating the down-mix by combining the down-mixes in response to the energy measures.

This may provide a particularly advantageous encoding.

According to an aspect of the invention there is provided a method of generating a multi-channel audio signal, the method comprising: receiving a down-mix being a combination of at least a first channel signal weighted by a first weight and a second channel signal weighted by a second weight, the first weight and the second weight having different amplitudes for at least some time-frequency intervals; receiving up-mix parametric data characterizing a relationship between the first channel signal and the second channel signal; generating a first weight estimate for the first weight and a second weight estimate for the second weight from the up-mix parametric data; and generating the multi-channel audio signal by up-mixing the down-mix in response to the up-mix parametric data, the first weight estimate and the second weight estimate, the up-mixing being dependent on an amplitude of at least one of the first weight estimate and the second weight estimate.

According to an aspect of the invention there is provided a method of generating an encoded representation of a multi-channel audio signal comprising at least a first channel and a second channel, the method comprising: generating a down-mix as a combination of at least a first channel signal of the first channel weighted by a first weight and a second channel signal of the second channel weighted by a second weight, the first weight and the second weight having different amplitudes for at least some time-frequency intervals; generating up-mix parametric data characterizing a relationship between the first channel signal and the second channel signal, the up-mix parametric data further characterizing the first weight and the second weight; and generating the encoded representation to include the down-mix and the up-mix parametric data.

According to an aspect of the invention there is provided audio bit-stream for a multi-channel audio signal comprising a down-mix being a combination of at least a first channel signal weighted by a first weight and a second channel signal weighted by a second weight, the first weight and the second weight having different amplitudes for at least some time-frequency intervals; and up-mix parametric data characterizing a relationship between the first channel signal and the second channel signal, the up-mix parametric data further characterizing the first weight and the second weight. The first and second weights may not be included in the bit-stream.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to encoding and decoding of a multi-channel signal with two channels (i.e. a stereo signal). Specifically, the description focuses on down-mixing of a stereo signal to a mono down-mix and associated parameters, and to the associated up-mixing. However, it will be appreciated that the invention is not limited to this application but may be applied to many other multi-channel (including stereo) systems such as for example MPEG Surround and parametric stereo as in HE-AAC v2.

Figure 1:
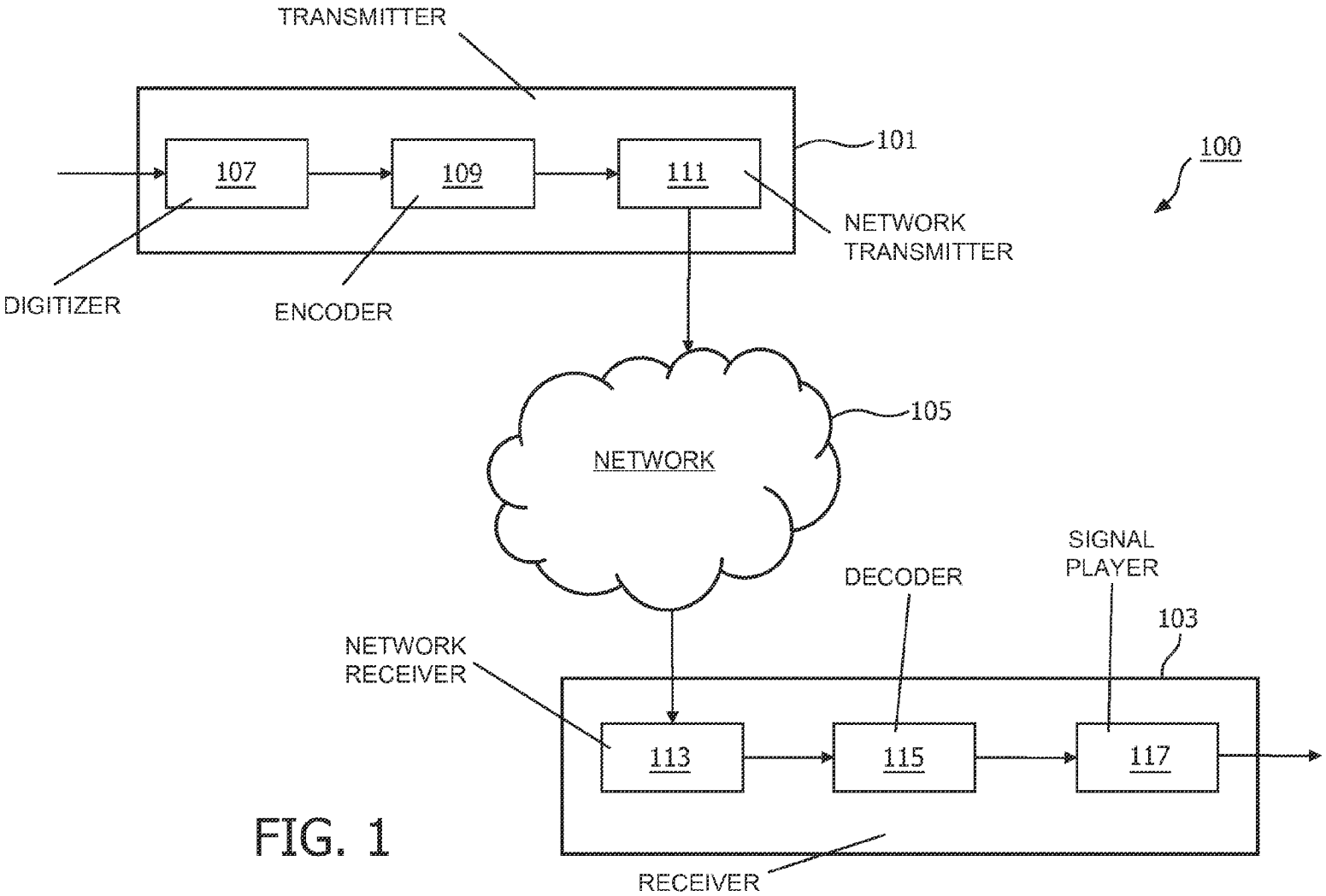
FIG. 1 is an illustration of an audio distribution system in accordance with some embodiments of the invention.

FIG. 1 illustrates a transmission system 100 for communication of an audio signal in accordance with some embodiments of the invention. The transmission system 100 comprises a transmitter 101 which is coupled to a receiver 103 through a network 105 which specifically may be the Internet.

In the specific example, the transmitter 101 is a signal recording device and the receiver 103 is a signal player device but it will be appreciated that in other embodiments a transmitter and receiver may used in other applications and for other purposes. For example, the transmitter 101 and/or the receiver 103 may be part of a transcoding functionality and may e.g. provide interfacing to other signal sources or destinations.

In the specific example where a signal recording function is supported, the transmitter 101 comprises a digitizer 107 which receives an analog signal that is converted to a digital PCM (Pulse Code Modulated) multi-channel signal by sampling and analog-to-digital conversion.

The digitizer 107 is coupled to the encoder 109 of FIG. 1 which encodes the multi-channel PCM signal in accordance with an encoding algorithm. The encoder 109 is coupled to a network transmitter 111 which receives the encoded signal and interfaces to the Internet 105. The network transmitter may transmit the encoded signal to the receiver 103 through the Internet 105.

The receiver 103 comprises a network receiver 113 which interfaces to the Internet 105 and which is arranged to receive the encoded signal from the transmitter 101.

The network receiver 113 is coupled to a decoder 115. The decoder 115 receives the encoded signal and decodes it in accordance with a decoding algorithm.

In the specific example where a signal playing function is supported, the receiver 103 further comprises a signal player 117 which receives the decoded audio signal from the decoder 115 and presents this to the user. Specifically, the signal player 117 may comprise a digital-to-analog converter, amplifiers and speakers as required for outputting the decoded multi-channel audio signal.

Figure 2:
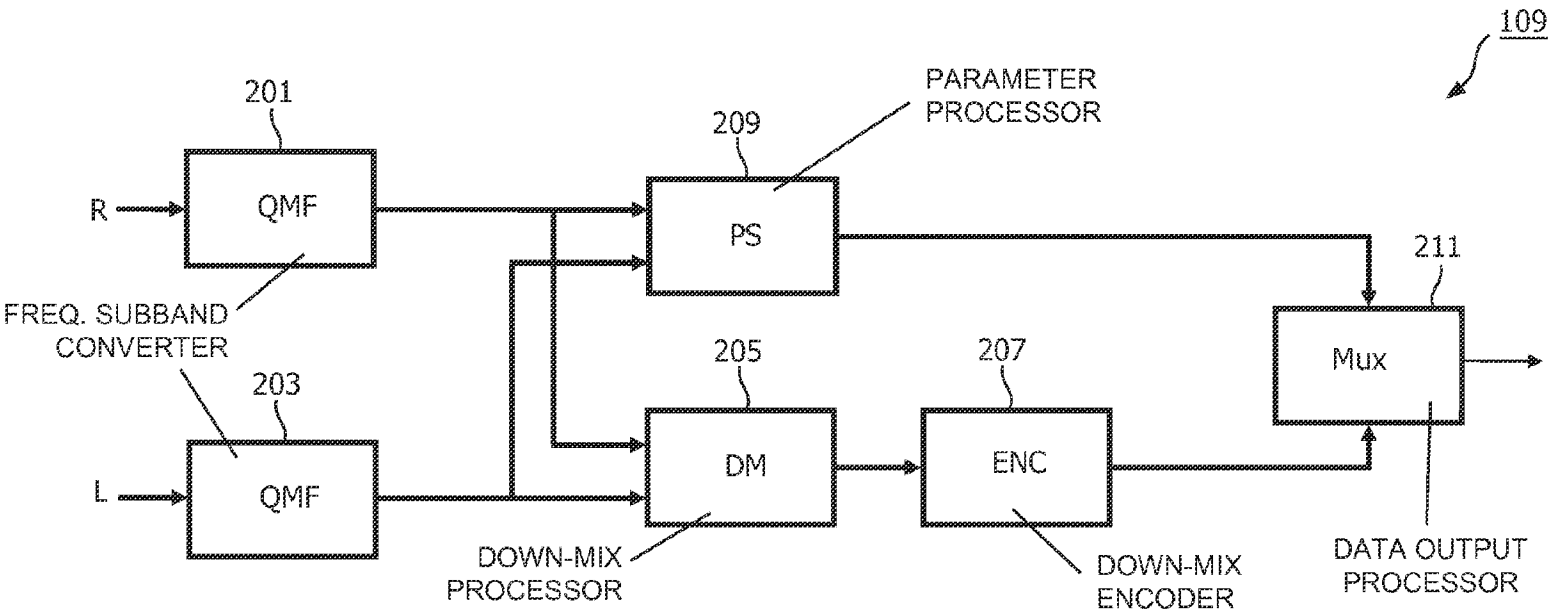
FIG. 2 is an illustration of elements of an audio encoder in accordance with some embodiments of the invention.

FIG. 2 illustrates the encoder 109 in more detail. The received left and right signals are first converted to the frequency domain. In the specific example the right signal is fed to a first frequency subband converter 201 which converts the right signal to a plurality of frequency subbands. Similarly, the left signal is fed to a second frequency subband converter 203 which converts the left signal into a plurality of frequency subbands.

The subband right and left signals are fed to a down-mix processor 205 which is arranged to generate a down-mix of the stereo signals as will be described in more detail later. In the specific example, the down-mix is a mono signal which is generated by combining the individual subbands of the right and left signals to generate a frequency domain subband down-mix mono signal. Thus, the down-mixing is performed on a subband basis. The down-mix processor 205 is coupled to a down-mix encoder 207 which receives the down-mix mono signal and encodes it in accordance with a suitable encoding algorithm. The down-mix mono signal transferred to the down-mix encoder 207 may be a frequency domain subband signal or it may first be transformed back to the time domain.

The encoder 109 furthermore comprises a parameter processor 209 which generates parametric spatial data that can be used by the decoder 115 to up-mix the down-mix to a multi-channel signal.

Specifically, the parameter processor 209 may group the frequency subbands into Bark or ERB sub-bands for which the stereo cues are extracted. The parameter processor 209 may specifically use a standard approach for generating the parametric data. In particular, the algorithms known from Parametric Stereo and MPEG Surround techniques may be used. Thus, the parameter processor 209 may generate the Interchannel Level Difference (ILD), Interchannel Coherence/Correlation (IC/ICC), Interchannel Phase Difference (IPD) or Interchannel Time Difference (ITD) for each parameter subband as will be known to the skilled person.

The parameter processor 209 and the down-mix encoder 207 are coupled to a data output processor 211 which multiplexes the encoded down-mix data and the parametric data to generate a compact encoded data signal which specifically may be a bit-stream.

Figure 3:
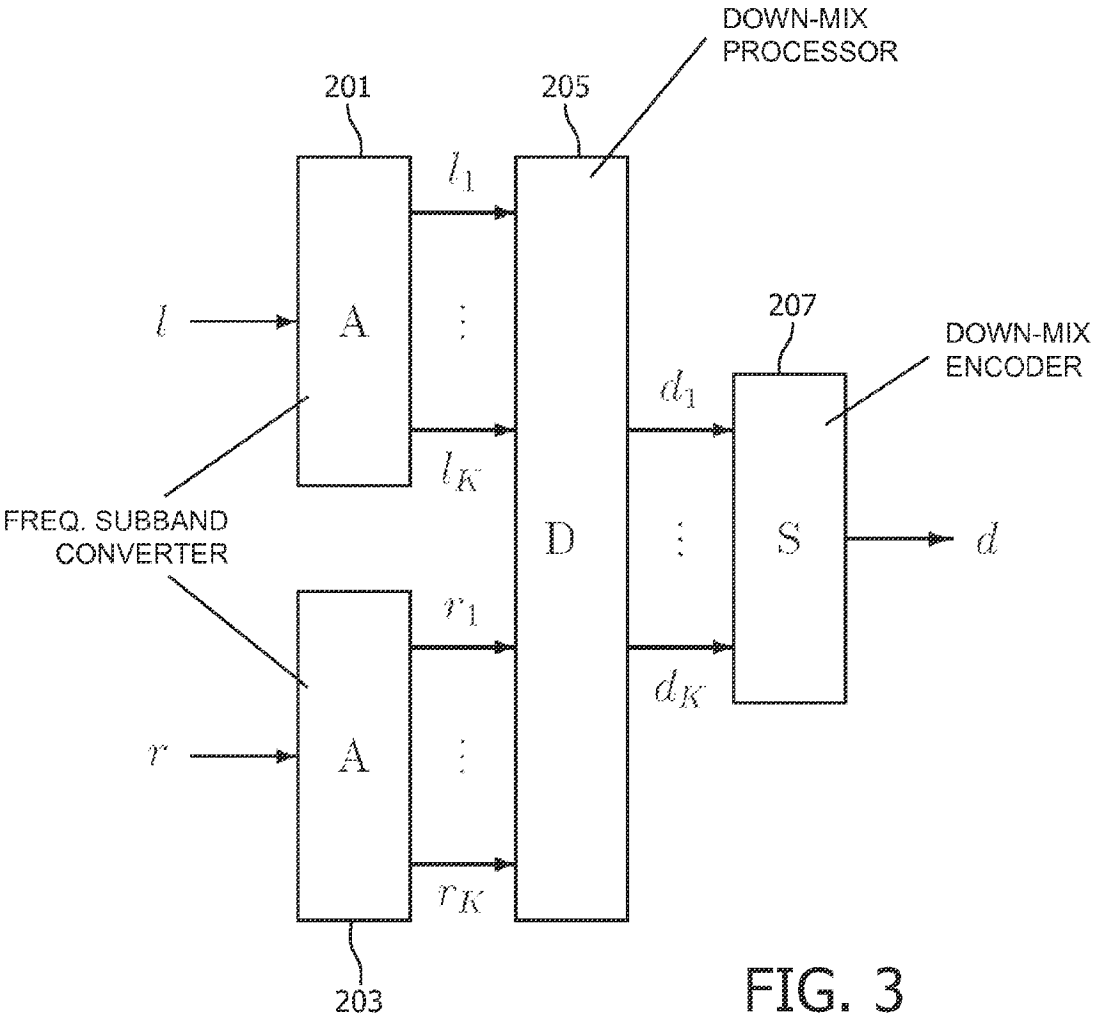
FIG. 3 is an illustration of elements of an audio encoder in accordance with some embodiments of the invention.

FIG. 3 illustrates the principle of the down-mix generation of the encoder 109 and illustrates the references that will be used in the following description. As illustrated, the left (l) and right (r) input signals are separately input to the first and second frequency subband converters 201, 203. The outputs are K frequency subband signals $l_1, \ldots, l_K$ and $r_1, \ldots, r_K$, respectively which are fed to the down-mix processor 205. The down-mix processor 205 generates the down-mix $(d_1, \ldots, d_K)$ from the left and right sub-band signals $(l_1, \ldots, l_K$ and $r_1, \ldots, r_K)$ which are fed to the down-mix encoder 207 to generate the time domain down-mix signal d which may then be encoded (in some embodiments, the sub-band down-mix is encoded directly).

In conventional systems, the down-mixing is performed by a linear summation of the left and right signals in each sub-band. Typically, a passive down-mix is performed by simply summing or averaging the left signal and the right signal. However, such an approach leads to substantial problems when the left and right signals are close to being out of phase with each other since the resulting summation signal will be reduced substantially, and may even be reduced to zero for completely out of phase signals. In some conventional systems, the summed signals may be scaled to result in a down-mix signal with an energy corresponding to the input signals. However, this may still be problematic as the relative error and uncertainty of the generated down-mix sample become more significant for low values. The energy normalization will not only scale the down-mix but also this associated error signal. Indeed, for completely out-of-phase signals, the resulting sum or average signal is zero and accordingly cannot be scaled.

In some systems, a weighted summation is used where the weights are not simple unit or scalar values but in addition introduce a phase shift to the left and right signals. This approach is used to provide phase alignment such that the summation of the left and right signals is performed in phase, i.e. it is used to phase align the signals for coherent summation. However, the generation of such a phase aligned down-mix has a number of disadvantages. In particular, it tends to be a complex and ambiguous operation which may result in reduced audio quality.

However, in contrast to these approaches the down-mix of the system of FIGS. 1-3 is generated by using weights that may not only have different phases but may also have different amplitudes. Thus, the amplitude of the weights for the two channels may at least for some signal characteristics have different values. Thus, in the generated down-mix the weighting of the two stereo channels is different.

Furthermore, the applied subband weights for the combination of the left and right subband signals into a down-mix subband are also signal dependent and vary as a function of the signal characteristics for the left and right signals. Specifically, in each subband, weights are determined dependent on the signal characteristics in the subband. Thus, both the phase and the amplitude are signal dependent and may vary. Therefore, the amplitude of the weights will be time varying.

Specifically, the weights may be modified such that a bias towards different amplitudes for the weights is introduced for left and right signals that are increasingly out of phase with each other. For example, the amplitude difference between the weights may be dependent on a cross-power measure for the left and right signals. The cross-power measure may be a cross-correlation of the left and right signals. The cross-power measure may be a normalized measure relative to the energy in at least one of the right and left channels.

Thus, the weights, and specifically both the phase and the amplitude, are in the specific example dependent on energy measures for the left signal and the right signal, as well as on a correlation between these (such as e.g. represented by a cross-power measure).

The weights are determined from signal characteristics of the left and right signals and may specifically be determined without consideration of the parametric data generated by the parameter processor 209. However, as will be demonstrated later, the generated parametric data is also dependent on signal energies and this may allow the decoder to recreate the weights used in the down-mix from the parametric data. Thus, although varying weights with different amplitudes are used, these weights need not be explicitly communicated to the decoder but can be estimated based on the received parametric data. Thus, in contrast to expectations, no additional data overhead needs to be communicated to support weights with different amplitudes.

Furthermore, the use of different weights can be used to avoid or mitigate out-of-phase problems associated with conventional fixed summation without needing to perform phase alignment and thus introducing the disadvantages associated therewith.

For example, a measure indicative of the power of a non-phase aligned combination of the left and right signals relative to the combined power of the left and right signals may be generated. Specifically, the power/energy of the sum signal for the left and right signals may be determined and related to the sum of the power/energy of the left signal and the power/energy of the right signal. A higher value of this measure will indicate that the left and right signals are not out of phase and that accordingly symmetric (even energy) weights may be used for the down-mix. However, for increasingly out of phase signals, the first power (that of the sum signal) reduces towards zero and thus a lower value of the measure will indicate that the left and right signals are increasingly out of phase and that a simple summation accordingly will not be advantageous as a down-mix signal. Accordingly, the weights may be increasingly asymmetric resulting in more contribution from one channel than the other in the down-mix thereby reducing the cancellation of one signal by the other. Indeed, for out-of-phase signals, the down-mix may e.g. be determined simply as one of the left and right signals, i.e. the energy of one weight may be zero.

As a more specific example, a measure, r, reflecting the ratio between the energy of the sum of the left and right signals and the phase-aligned left and right signals (i.e. the energy following coherent in phase addition of the left and right signals) can be determined:

$$r = \frac{E\{\langle l + r\rangle\}}{E\{\langle l + re^{j\cdot ipd}\rangle\}},$$

where ipd is the phase difference between the left and right signals (which is also one of the parameters determined by the parameter processor 209), <.> denotes the inner product and E{.} is the expectation operator.

The relative value above is thus generated to reflect a relative relationship between an energy measure for the sum of the left and right signals and an energy measure indicative of the energy of the phase aligned combination of the left and right signals. The weights are then determined from this relative value.

The ratio r is indicative of how much the two signals are out of phase. In particular, for completely out of phase signals, the ratio is equal to 0 and for completely in phase signals the ratio is equal to 1. Thus, the ratio provides a normalized ([0,1]) measure of how much energy reduction occurs due to the phase differences between left and right channels.

It can be shown that:

$$r = \frac{E\{\langle l + r\rangle\}}{E\{\langle l + re^{j\cdot ipd}\rangle\}} = \frac{E_l + E_r + 2\mathcal{R}\{E_{lr}\}}{E_l + E_r + 2|E_{lr}|},$$

where $E_l$ and $E_r$ are the energies of the left and right signals and $E_{lr}$ is the cross-correlation between the left and right signals.

Then using:

$$iid = \frac{E_l}{E_r},$$

$$icc \cdot \exp(j \cdot ipd) = \frac{E_{lr}}{\sqrt{E_l}\sqrt{E_r}},$$

where iid is the interchannel intensity difference and icc is the interchannel coherence, this can be shown to lead to:

$$r = \frac{iid + 1 + 2\cdot\cos(ipd)\cdot icc\cdot\sqrt{iid}}{iid + 1 + 2\cdot icc\cdot\sqrt{iid}}.$$

Thus, as illustrated, the measure r which is indicative of how much the signals are out of phase can be derived from the parametric data and thus can be determined by the decoder 115 without requiring any additional data to be communicated.

The ratio may be used to generate the weights for the down-mix signals. Specifically, the down-mix signal may in each subband be generated as:

$$d(n)=w_1 l(n)+w_2 r(n).$$

The weights may be generated from the ratio r such that the asymmetry (energy difference) increases as r approaches zero. For example, an intermediate value may be generated as:

$$q=r^{1/4}$$

Using the intermediate value q, two gains are calculated as:

$$g_1=2-q,$$

$$g_2=q.$$

The weights can then be determined by an optional energy normalization:

$$w_1=g_1\cdot c,$$

$$w_2=g_2\cdot c,$$

where c is chosen to provide the desired normalization. Specifically, c may be selected such that the energy of the resulting down-mix is equal to the power of the left signal plus the power of the right signal.

As another example, the intermediate value may be generated as:

$$q = \begin{cases} 0 & r < 0.5 \\ \dfrac{r - 0.5}{0.75 - 0.5} & 0.5 \le r \le 0.75 \\ 1 & r > 0.75, \end{cases}$$

which will tend to provide weights that are constant (either completely symmetric or completely asymmetric) for an increasing variety of signal conditions.

Thus, the encoder 109 may in such an embodiment employ a flexible and dynamic down-mix where the weights are automatically adapted to the specific signal conditions such that disadvantages associated with fixed or phase aligned down-mixing can be avoided or mitigated. Indeed, the approach may gradually and automatically adapt from a completely symmetric down-mix treating both channels equally to a completely asymmetric down-mix where one channel is completely ignored. This adaptation may allow the down-mix to provide an improved signal on which to base the up-mix, while at the same time generating a down-mix signal that can be used directly (i.e. it can be used as a mono-signal). Furthermore, the described example provides a very gradual and smooth transition of the energy difference thereby providing an improved listening experience.

Also, as will be demonstrated later, this improved performance can be achieved without requiring any additional data to be distributed to provide information of the selected weights. Specifically, as demonstrated above, the weights can be determined from the transmitted parametric data and, as will be demonstrated later, the conventional approaches for up-mixing based on assumptions of equal down-mix weights can be modified and extended to allow up-mixing for weights with different energies (or equivalently different amplitudes or powers).

In the following, another example of an encoding approach using different down-mix weights will be described. In some scenarios, the down-mix may created without using the parametric data. In other scenarios or embodiments, the parametric data may also be used in the encoder to determine the weights. The approach is based on the determination of a plurality of intermediate down-mixes using predetermined weights (which specifically may be energy symmetric, i.e. may have the same energy and only e.g. introduce a phase offset). The intermediate down-mixes are then combined into a single down-mix where each of the intermediate down-mixes is weighted dependent on the energy of the intermediate down-mix. Thus, intermediate down-mixes which have low energy because they originated from the combination of substantially out of phase signals is weighted lower than intermediate down-mixes which have a high energy because the originate from more coherent combinations. The resulting down-mix may then be energy normalized relative to the input signals.

In more detail, set of different a priori (intermediate) sub-band down-mixes $\hat{d}_{p,k}$, p=1, . . . , P is generated as:

$$\hat{d}_{p,k}(n)=w_{p,1}l_k(n)+w_{p,2}r_k(n).$$

Typically, the number of intermediate down-mixes can be kept low thereby resulting in low complexity and reduced computational requirements. In particular, the number of intermediate sub-band down-mixes is ten or less and particularly advantageous trade-off between complexity and performance has been found for four intermediate down-mixes.

In the specific example four (P=4) a priori (predetermined and fixed) intermediate down-mixes are used with the specific weights:

| p | $w_{p,1}$ | $w_{p,2}$ |
|---|---|---|
| 1 | 1 | 1 |
| 2 | q | q* |
| 3 | q* | q |
| 4 | 1 | −1 |

with $j=\sqrt{-1}$, $q=(1+j)/\sqrt{2}$ and * denoting conjugation. The weights may also be expressed in matrix form:

$$M = \begin{bmatrix} 1 & 1 \\ \frac{1+j}{\sqrt{2}} & \frac{1-j}{\sqrt{2}} \\ \frac{1-j}{\sqrt{2}} & \frac{1+j}{\sqrt{2}} \\ 1 & -1 \end{bmatrix}.$$

These a priori down-mixes correspond to optimal down-mixes for the cases that the left and right signals are equal in amplitude and 0, 90, 180 or 270 degrees out of phase. Alternatively a set of only two a-priori down-mixes can be used, e.g., p=1 and p=4.

Next, the energies $E_{p,k}(n)$ of each of these options are determined by $$E_{p,k}(n) = \sum_m |\hat{d}_{p,k}(m)|^2 w(m),$$

with w being an optional window centered around sample index n. The sub-band down-mixes are combined to form a new sub-band down-mix $\tilde{d}_k$ by $$\tilde{d}_k(n) = \sum_{p=1}^{P} \alpha_{p,k}\hat{d}_{p,k}(n),$$

where the weights $\alpha_{p,k}$ are determined from the relative strength of the down-mixes. Thus, the different intermediate mixes are combined into a single down-mix by weighting each of them in accordance with their relative strength.

The relative strength can be based on energy such as e.g., $$\alpha_{p,k}(n) = \sqrt{\frac{E_{p,k}(n)}{\varepsilon + \sum_{p=1}^{P} E_{p,k}(n)}},$$

where $\epsilon$ is a small positive constant to prevent division by zero. Other measures, such as envelope measures, can of course also be used.

The final down-mix $d_k$ is generated from $\tilde{d}_k$ by an energy normalization. Specifically, the energy of $\tilde{d}_k$ can be determined and the required scaling in order to adjust this to be equal to that of the sum of the energies of left and right signal can be performed.

As a specific example, for each down-mix the biased sum energy-ratio can be calculated as:

$$r_m = \sqrt{\frac{E_m}{E_{tot}}} \cdot b(m) = \sqrt{\frac{iid + 1 + 2\Re\{M(m,0)\cdot M^*(m,1)\cdot icc\cdot \exp(j\cdot ipd)\cdot\sqrt{iid}\}}{4(iid+1)}} \cdot b(m),$$

where b(m) is a biasing function which may introduce an additional bias to the default down-mix, according to:

$$b(m) = \begin{cases} 2 - \dfrac{icc \cdot \sqrt{idd}}{idd + 1} & m = 0 \\ \dfrac{icc \cdot \sqrt{iid}}{iid + 1} & \text{elsewhere,} \end{cases}$$

Then, two gains are calculated as:

$$g_1 = \sum_{\forall m} r_m \cdot M(m, 0),$$

$$g_2 = \sum_{\forall m} r_m \cdot M(m, 1),$$

and the final weights are determined by an energy normalization:

$$w_1 = g_1 \cdot c,$$

$$w_2 = g_2 \cdot c,$$

where c is selected such that the energy of the resulting down-mix is equal to the power of the left channel plus the power of the right channel.

It should be noted that these approaches allow the weights to be generated by the decoder 115 using the received parametric data and does not require any additional information to be transmitted.

The described approach avoids or mitigates both the disadvantages of the passive and active (fixed) down-mixing associated with out of phase signals without having to use phase alignment and the associated disadvantages.

An advantage of the described approach is that the linear combination of a plurality of different intermediate down-mixes provide an additional robustness since out of phase problems are likely to be restricted to only one or possibly two of the down-mixes. Furthermore, by using only four intermediate down-mixes, an efficient and low computational resource demand can be achieved.

It is also worth noting that, ultimately, the down-mix signal $\tilde{d}_k$ is just a linear combination of the left and right signals, i.e., $$\tilde{d}_k(n) = \beta_{k,1} l_k(n) + \beta_{k,2} r_k(n),$$

where each $\beta_{k,i}$, i=1, 2 depends on $E_{p,k}$ and the chosen $w_{p,q}$.

It is also worth noting that $E_{p,k}$ depends on the energies of left and right and the cross-energy. In particular, it can be shown that:

$$E_{p,k} = E_1 + E_2 + 2\Re\{w_{p,1} w^*_{p,2} E_{12}\},$$

where $\Re\{.\}$ denotes the real part of a complex number. This allows a computationally simpler scheme since the intermediate down-mix energies do not need to be measured and indeed the intermediate down-mixes do not need to be explicitly generated. Rather, the $\alpha_{p,k}$ values can be derived from the selected a priori down-mix weights $w_{p,q}$ and the energy $E_{p,k}$ where the latter directly follow from the measured energies and cross-energy of the original signals as indicated above.

Consequently, $\beta_{k,i}$ follows from the chosen $w_{p,i}$ and the measured energies and cross-energy since $$\beta_{k,i} = \sum_{p=1}^{P} \alpha_{p,k} w_{p,i},$$

Also the energy compensation easily follows from the input energies and the knowledge of $\beta_{k,i}$.

The described approach may be less efficient for scenarios where the correlation between the left and right signals is low, or when the energies of left and right signal are substantially different. However, in these cases, a good down-mix is provided by the simple sum of the left and right signal.

This consideration can be used to modify the approach as follows. First, the modulation index μ is defined as $$\mu = \frac{|E_{12}|}{E_1 + E_2}.$$

where $E_1$, $E_2$ and $E_{12}$ are the energies of left signal, right signal and the cross-energy respectively. Note that $0 \le \mu \le 1$.

The calculation of α can now be adapted to prefer down-mix p=1 (assuming that this corresponds to mid signal as in our example) if μ is low by for instance $$\alpha_{1,k}(n) = (2 - \mu)\sqrt{\frac{E_{p,k}(n)}{\varepsilon + \sum_{p=1}^{P} E_{p,k}(n)}},$$

$$\alpha_{p,k}(n) = \mu\sqrt{\frac{E_{p,k}(n)}{\varepsilon + \sum_{p=1}^{P} E_{p,k}(n)}} \quad \text{for } p = 2, \ldots, P.$$

This leads to a creation of a down-mix which has numerical robustness yet includes out-of-phase components into the down-mix as well.

Again, it should be noted that the down-mix generation using intermediate fixed down-mixes is based on the down-mix parameters which indeed are signal-dependent. However, the dependence of the resulting down-mix weights are only dependent on the energies $E_1$, $E_2$ and the cross-energy $E_{12}$. As this is also the case for the parameter data (e.g. the generated ILD, IPD, and IC) it is possible for the decoder 115 to derive the applied weights from the transmitted parametric data. Specifically, the weights can be found by the decoder evaluating the same functions as described above with reference to the encoder 109.

In more detail the weight for a given down-mix signal can be found from the parameters by first considering μ as:

$$\mu = \frac{|E_{12}|}{E_1 + E_2} = \frac{icc \cdot \sqrt{iid}}{iid + 1}$$

Then, using the following relation $\alpha_{p,k}$ (n) can be calculated for all p:

$$\sqrt{\frac{E_{p,k}(n)}{\varepsilon + \sum_{p=1}^{P} E_{p,k}(n)}} = \sqrt{\frac{iid + 1 + 2\Re\{w_{p,1} w^*_{p,2} \cdot icc \cdot \sqrt{iid} \cdot \exp(j \cdot ipd)\}}{\varepsilon + \sum_{p=1}^{P} iid + 1 + 2\Re\{w_{p,1} w^*_{p,2} \cdot icc \cdot \sqrt{iid} \cdot \exp(j \cdot ipd)\}}}.$$

From this, $\beta_{k,i}$ follows as:

$$\beta_{k,i} = \sum_{p=1}^{P} \alpha_{p,k} w_{p,i}.$$

In the above, various encoder approaches have been described which apply a signal dependent dynamic variation of the down-mix weights (including amplitude variations) to provide a more robust and improved down-mix signal. The approaches specifically utilize asymmetric weights (with potentially different amplitudes) to improve the performance. Furthermore, as has been demonstrated, the down-mix weights can be derived from the weights and thus can be determined by the decoder, thereby allowing a decoder operation which performs up-mixing based on an assumption of an encoder approach that uses different energies for the weights. This up-mixing is based only on the down-mix and the spatial parameters and does not require any additional information. Thus, the decoder operation has been modified to account for weights which have different amplitudes, and thus is not based on an assumption of equal amplitude down-mix weights as conventional decoders. In the following different examples of such decoders will be described and it will be demonstrated that not only can up-mixing approaches be modified to operate with asymmetric amplitude down-mix weights but furthermore this can be achieved based on the existing parametric data and without requiring additional data to be communicated.

Figure 4:
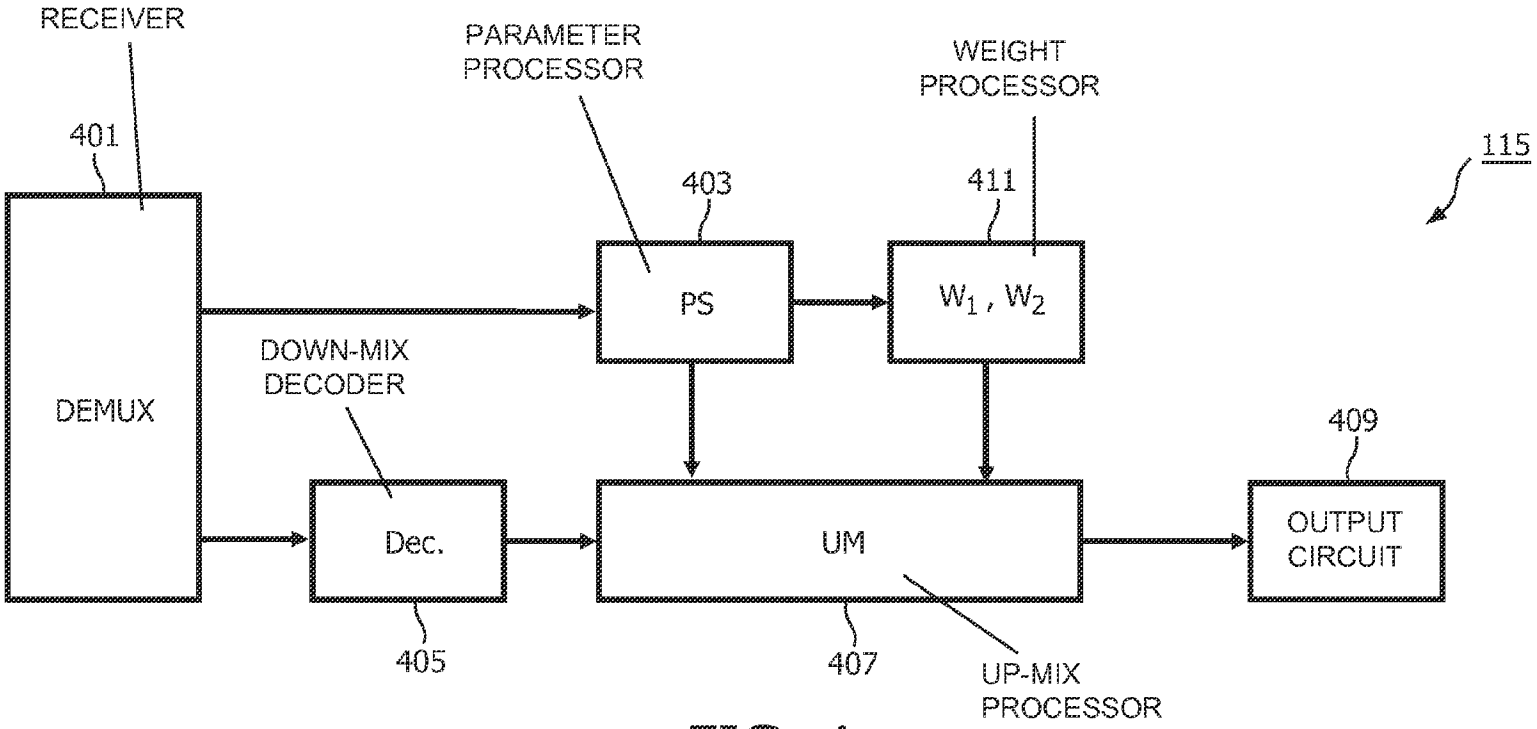
FIG. 4 is an illustration of elements of an audio decoder in accordance with some embodiments of the invention.

FIG. 4 illustrates an example of a decoder in accordance with some embodiments of the invention.

The decoder comprises a receiver 401 which receives the data stream from the encoder 109. The receiver 401 is coupled to a parameter processor 403 which receives the parametric data from the data stream. Thus, the parameter processor 403 receives the IID, IPD and ICC values from the data stream.

The receiver 401 is furthermore coupled to a down-mix decoder 405 which decodes the received encoded down-mix signal. The down-mix decoder 405 performs the reverse function of the down-mix encoder 207 of the encoder 109 and thus generates a decoded frequency domain subband signal (or a time domain signal which is then converted to a frequency domain subband signal).

The down-mix decoder 405 is furthermore coupled to an up-mix processor 407 which is also coupled to the parameter processor 403. The up-mix processor 407 up-mixes the down-mix signal to generate a multi-channel signal (which in the specific example is a stereo signal). In the specific example, the mono down-mix is up-mixed to the left and right channels of a stereo signal. The up-mixing is performed on the basis of the parametric data and the determined estimates of the down-link weights which may be generated from the parametric data. The up-mixed stereo channel is fed to an output circuit 409 which in the specific example may include a conversion from the frequency subband domain to the time domain. The output circuit 409 may specifically include an inverse QMF or FFT transform.

In the decoder of FIG. 4, the parameter processor 403 is coupled to a weight processor 411 which is further coupled to the up-mix processor. The weight processor 411 is arranged to estimate the down-mix weights from the received parametric data. This determination is not limited to an assumption of equal weights. Rather, whereas the decoder 115 may not necessarily know exactly which down-mix weights have been applied in the encoder 109, the decoding is based on the use of potentially asymmetric weights with an (amplitude) difference between the weights. Thus, the received parameters are used to determine the energy/amplitude and/or angle of the weights. In particular, the determination of the weights is performed in response to the parameters indicative of energy relationships between the channels. Specifically, the determination is not limited to the phase value of the IPD but is in response to IID and/or ICC values.

The determination of the applied weights specifically use the same approach as previously described for the encoder 115. Thus, the same calculations as previously described for the encoder 109 may be performed by the weight processor 411 to result in weights $w_1$ and $w_2$ that will (or are assumed to) have been used by the corresponding encoder 109.

The up-mixing performed by conventional decoders is based on an assumption of the applied weights being identical for the two channels or only differing by a phase value. However, in the decoder 115 of FIG. 4 the up-mixing also takes into account the amplitude difference between the weights and is specifically modified such that the actual estimated weights $w_1$ and $w_2$ from the parameter processor 403 are used to modify the up-mixing. Thus, the conventional up-mix approaches have been modified to further consider dynamically varying signal dependent weights for which estimates are calculated from the received parametric data.

In the following, specific examples of up-mix algorithms that have been extended to accommodate weights with different energies will be presented.

Up-mix methods which use an Overall Phase Difference indicative of the absolute (average) phase offset of the sub-band left and right channels relative to a fixed reference (typically the left channel) are known.

Specifically, the Parametric Stereo standard uses the following up-mix:

$$\begin{bmatrix} l \\ r \end{bmatrix} = \begin{bmatrix} c_1 \cdot \cos(\alpha+\beta) \cdot e^{jopd} & c_1 \cdot \sin(\alpha+\beta) \cdot e^{jopd} \\ c_2 \cdot \cos(-\alpha+\beta) \cdot e^{j(opd-ipd)} & c_2 \cdot \sin(-\alpha+\beta) \cdot e^{j(opd-ipd)} \end{bmatrix} \begin{bmatrix} s \\ s_d \end{bmatrix},$$

where s is the received mono-down-mix and $s_d$ is a decorrelated signal generated by the decoder as will be known to the skilled person. $c_1$ and $c_2$ are gains to ensure correct level differences between the left and right signals Specifically, $c_1$, $c_2$, $\alpha$ and $\beta$ may be determined as:

$$c_1 = \sqrt{\frac{iid}{1+iid}},$$

$$c_2 = \sqrt{\frac{1}{1+iid}},$$

$$\alpha = \frac{1}{2}\arccos(icc),$$

$$\beta = \arctan\left(\tan(\alpha) \cdot \frac{c_2 - c_1}{c_2 + c_1}\right).$$

This equation is still valid for the scenario where the weights $w_1$ and $w_2$ have different energies if the OPD value is suitably modified. Thus, no modification of the above equation is necessary for the decoding of signals allowing energy differences between the weights. This is because the up-mix matrix always reinstates the correct spatial cues (IID, ICC, IPD) independent of the OPD. The OPD can be seen as an additional degree of freedom.

The OPD is defined as the angle between the left channel and the sum signal, $s_s$ generated by summing the left and right signals:

$$\begin{aligned} opd &= \angle\{\langle l, s_s\rangle\} \\ &= \angle\{\langle l, w_1 \cdot l + w_2 \cdot r\rangle\} \\ &= \angle\{\langle l, w_1 \cdot l\rangle + \langle l, w_2 \cdot r\rangle\} \\ &= \angle\{w_1^*\langle l, l\rangle + w_2^*\langle l, r\rangle\}. \end{aligned}$$

Furthermore, $$\angle\{\langle l, s_s\rangle\} = \arctan\left(\frac{\mathcal{J}\{\langle l, s_s\rangle\}}{\mathcal{R}\{\langle l, s_s\rangle\}}\right),$$

and $$\begin{aligned} w_1^*\langle l, l\rangle + w_2^*\langle l, r\rangle &= (w_{1r} - jw_{1,i})\cdot P_{ll} + (w_{2r} - jw_{2i})\cdot P_{lr} \\ &= w_{1r}\cdot P_{ll} + w_{2r}\cdot w_{lr}^{\mathcal{R}} + q_{2i}\cdot w_{lr}^{\mathcal{J}} - j\cdot \\ &\quad (w_{1i}\cdot P_{ll} - w_{2r}\cdot P_{lr}^{\mathcal{J}} + w_{2i}\cdot P_{lr}^{\mathcal{R}}), \end{aligned}$$

where $P_{ll}$ is the power of the left signal, and $P_{lr}$ is the cross-power or cross-correlation of the left and right signals.

Thus:

$$\begin{aligned} opd &= \arctan\left(\frac{\mathfrak{J}\{\langle l, s\rangle\}}{\mathfrak{R}\{\langle l, s\rangle\}}\right) \\ &= \arctan\left\{\frac{-w_{1i}\cdot P_{ll} + w_{2r}\cdot P_{lr}^{\mathfrak{J}} - w_{2i}\cdot P_{lr}^{\mathfrak{R}}}{w_{1r}\cdot P_{ll} + w_{2r}\cdot P_{lr}^{\mathfrak{R}} + w_{2i}\cdot P_{lr}^{\mathfrak{J}}}\right\} \\ &= \arctan\left\{\frac{-w_{1i}\cdot \frac{P_{ll}}{P_{rr}} + w_{2r}\cdot \frac{P_{lr}^{\mathfrak{J}}}{P_{rr}} - w_{2i}\cdot \frac{P_{lr}^{\mathfrak{R}}}{P_{rr}}}{w_{1r}\cdot \frac{P_{ll}}{P_{rr}} + w_{2r}\cdot \frac{P_{lr}^{\mathfrak{R}}}{P_{rr}} + w_{2i}\cdot \frac{P_{lr}^{\mathfrak{J}}}{P_{rr}}}\right\} \\ &= \arctan\left\{\frac{-w_{1i}\cdot iid + w_{2r}\cdot icc\cdot \sin(ipd)\cdot\sqrt{iid} - w_{2i}\cdot icc\cdot\cos(ipd)\cdot\sqrt{iid}}{w_{1r}\cdot iid + w_{2r}\cdot icc\cdot\cos(ipd)\cdot\sqrt{iid} + w_{2i}\cdot icc\cdot\sin(ipd)\cdot\sqrt{iid}}\right\}, \end{aligned}$$

where $P_{rr}$ is the power of the right signal.

Thus, the weights $w_1$ and $w_2$ may first be determined by the weight processor 411 based on the parametric data as previously described, and the estimated weights may then be used together with the parametric data to generate an overall phase value that takes into account the potentially asymmetric weighting (i.e. the difference between the weights including the amplitude asymmetry). The generated overall phase value may then be used to generate the up-mixed signal from the down-mix signal and a correlated signal.

In some embodiments, the OPD value may be generated under the assumption that the channels are correlated, i.e. that the icc parameter has a unity value. This leads to the following OPD value:

$$opd = \arctan\left\{\frac{-w_{1i}\cdot iid + w_{2r}\cdot\sin(ipd)\cdot\sqrt{iid} - w_{2i}\cdot\cos(ipd)\cdot\sqrt{iid}}{w_{1r}\cdot iid + w_{2r}\cdot\cos(ipd)\cdot\sqrt{iid} + w_{2i}\cdot\sin(ipd)\cdot\sqrt{iid}}\right\}.$$

Thus, the decoder may generate an up-mixed signal which does not suffer as much from the typical disadvantages associated a fixed summation or phase alignment down-mix approaches. Furthermore, this is achieved without requiring additional data to be sent.

As another example, the up-mixing may be based on a prediction of the decorrelated signal from the down-mix signal. The down-mix is generated as $$s = w_1\cdot l + w_2\cdot r,$$

where both $w_1$ and $w_2$ may be complex. Then an auxiliary signal can be constructed using a scaled complex rotation resulting in an overall down-mix matrix of:

$$\begin{bmatrix} s \\ d \end{bmatrix} = W\begin{bmatrix} l \\ r \end{bmatrix} = \begin{bmatrix} w_1 & w_2 \\ -w_2^* & w_1^* \end{bmatrix}\begin{bmatrix} l \\ r \end{bmatrix}.$$

Thus, the signal d represents a difference signal for the left and right signals.

The resulting theoretical up-mix matrix can be determined as:

$$\begin{bmatrix} l \\ r \end{bmatrix} = W^{-1}\begin{bmatrix} s \\ d \end{bmatrix} = \frac{1}{|w_1|^2 + |w_2|^2}\begin{bmatrix} w_1^* & -w_2 \\ w_2^* & w_1 \end{bmatrix}\begin{bmatrix} s \\ d \end{bmatrix}.$$

The difference signal may be expressed by a predictable component which can be predicted from the down-mix signal s and an unpredictable component which is decorrelated with the down-mix signal s. Thus, d can be expressed as:

$$d = \alpha\cdot s + \beta\cdot s_d,$$

where $s_d$ is a decoder generated de-correlated sum signal, $\alpha$ is a complex prediction factor, and $\beta$ is a (real-valued) decorrelation scaling factor. This leads to:

$$\begin{aligned} \begin{bmatrix} l \\ r \end{bmatrix} &= \frac{1}{|w_1|^2 + |w_2|^2}\begin{bmatrix} w_1^* & -w_2 \\ w_2^* & w_1 \end{bmatrix}\begin{bmatrix} s \\ \alpha\cdot s + \beta\cdot s_d \end{bmatrix} \\ &= \frac{1}{|w_1|^2 + |w_2|^2}\begin{bmatrix} w_1^* - \alpha\cdot w_2 & -\beta\cdot w_2 \\ w_2^* + \alpha\cdot w_1 & \beta\cdot w_1 \end{bmatrix}\begin{bmatrix} s \\ s_d \end{bmatrix}. \end{aligned}$$

Thus, provided the prediction factor $\alpha$ and the decorrelation scaling factor $\beta$ can be determined, the up-mix may be generated by this approach.

In the previous equation for generating the difference signal, the second term of $\beta\cdot s_d$ represents the part of the difference signal which cannot be predicted from the down-mix signal s. In order to keep a low data rate, this residual signal component is typically not communicated to the decoder and therefore the up-mix is based on the locally generated decorrelated signal and the decorrelation scaling factor.

However, in some cases, the residual signal $\beta\cdot s_d$ is encoded as a signal $d_{res}$ and communicated to the decoder. In such cases, the difference signal may be given as:

$$d = \alpha\cdot s + d_{res},$$

which leads to:

$$\begin{bmatrix} l \\ r \end{bmatrix} = \frac{1}{|w_1|^2 + |w_2|^2} \begin{bmatrix} w_1^* & -w_2 \\ w_2^* & w_1 \end{bmatrix} \begin{bmatrix} s \\ \alpha \cdot s + d_{res} \end{bmatrix}$$

$$= \frac{1}{|w_1|^2 + |w_2|^2} \begin{bmatrix} w_1^* - \alpha \cdot w_2 & -w_2 \\ w_2^* + \alpha \cdot w_1 & w_1 \end{bmatrix} \begin{bmatrix} s \\ d_{res} \end{bmatrix}.$$

Furthermore, both the prediction factor α and the decorrelation scaling factor β can be determined from the received parametric data:

$$\alpha = \frac{(1 - \mathbf{iid}) \cdot w_2^* \cdot w_1^* - \mathbf{icc} \cdot \sqrt{\mathbf{iid}} \cdot \begin{pmatrix} w_2^* \cdot w_2^* \cdot \exp(\mathbf{j} \cdot \mathbf{ipd}) - \\ w_1^* \cdot w_1^* \cdot \exp(-\mathbf{j} \cdot \mathbf{ipd}) \end{pmatrix}}{|w_1|^2 \cdot \mathbf{iid} + |w_2|^2 + 2 \cdot \mathbf{icc} \cdot \sqrt{\mathbf{iid}} \cdot \Re\{w_1 \cdot w_2^* \cdot \exp(\mathbf{j} \cdot \mathbf{ipd})\}},$$

$$\beta = \frac{\sqrt{\mathbf{iid} \cdot \begin{pmatrix} 2 \cdot |w_1|^2 \cdot |w_2|^2 + (1 - \mathbf{icc}^2) \cdot (|w_1|^4 + |w_2|^4) - \\ 2 \cdot \mathbf{icc}^2 \cdot |w_1 \cdot w_2^* \cdot \exp(\mathbf{j} \cdot \mathbf{ipd})|^2 \end{pmatrix}}}{|w_1|^2 \cdot \mathbf{iid} + |w_2|^2 + 2 \cdot \mathbf{icc} \cdot \sqrt{\mathbf{iid}} \cdot \Re\{w_1 \cdot w_2^* \cdot \exp(\mathbf{j} \cdot \mathbf{ipd})\}}.$$

Thus, the prediction based approach allows an up-mixing to be performed which is based on an assumption of asymmetric energy weights being used for the down-mix. Furthermore, the up-mix process is controlled by the parametric data and no additional information needs to be transmitted from the encoder.

In more detail, the complex prediction factor α and the decorrelation scaling factor β can be derived from the following considerations.

Firstly, prediction parameter a is given as:

$$\alpha = \frac{\langle d, s \rangle}{\langle s, s \rangle},$$

where $$\langle a, b \rangle = \sum_k a_k \cdot b_k^*.$$

This leads to $$\alpha = \frac{\langle d, s \rangle}{\langle s, s \rangle}$$

$$= \frac{-w_2^* \cdot w_1^* \langle l, l \rangle - w_2^* \cdot w_2^* \langle l, r \rangle + w_1^* \cdot w_1^* \cdot \langle l, r \rangle^* + w_1^* \cdot w_2^* \cdot \langle r, r \rangle}{|w_1|^2 \cdot \langle l, l \rangle + 2\Re\{w_1 \cdot w_2^* \cdot \langle l, r \rangle\} + |w_2|^2 \cdot \langle r, r \rangle}.$$

Then, using the parameter definition:

$$\mathbf{iid} = \frac{\langle l, l \rangle}{\langle r, r \rangle}$$

$$\mathbf{icc} \cdot \exp(\mathbf{j} \cdot \mathbf{ipd}) = \frac{\langle l, r \rangle}{\sqrt{\langle l, l \rangle \cdot \langle r, r \rangle}},$$

this yields:

$$\alpha = \frac{(1 - \mathbf{iid}) \cdot w_2^* \cdot w_1^* - \mathbf{icc} \cdot \sqrt{\mathbf{iid}} \cdot (w_2^* \cdot w_2^* \cdot \exp(\mathbf{j} \cdot \mathbf{ipd}) - w_1^* \cdot w_1^* \cdot \exp(-\mathbf{j} \cdot \mathbf{ipd}))}{|w_1|^2 \cdot \mathbf{iid} + |w_2|^2 + 2 \cdot \mathbf{icc} \cdot \sqrt{\mathbf{iid}} \cdot \Re\{w_1 \cdot w_2^* \cdot \exp(\mathbf{j} \cdot \mathbf{ipd})\}}.$$

The decorrelation scaling factor β is given as:

$$\beta = \sqrt{\frac{\langle d, d \rangle}{\langle s, s \rangle} - |\alpha|^2},$$

using the assumption that the power of the decorrelated signal matches the power of the sum signal.

$$\beta = \sqrt{\frac{\langle d, d \rangle}{\langle s, s \rangle} - |\alpha|^2}$$

$$= \sqrt{\frac{|w_2|^2 \cdot \mathbf{iid} - 2 \cdot \mathbf{icc} \cdot \sqrt{\mathbf{iid}} \cdot \Re\{w_1 \cdot w_2^* \cdot \exp(\mathbf{j} \cdot \mathbf{ipd})\} + |w_1|^2}{|w_1|^2 \cdot \mathbf{iid} + 2 \cdot \mathbf{icc} \cdot \sqrt{\mathbf{iid}} \cdot \Re\{w_1 \cdot w_2^* \cdot \exp(\mathbf{j} \cdot \mathbf{ipd})\} + |w_2|^2} - |\alpha|^2},$$

from which follows $$\beta = \frac{\left(\sqrt{\mathbf{iid} \cdot (2 \cdot |w_1|^2 \cdot |w_2|^2 + (1 - \mathbf{icc}^2) \cdot (|w_1|^4 + |w_2|^4) - 2 \cdot \mathbf{icc}^2 \cdot |w_1 \cdot w_2^* \cdot \exp(\mathbf{j} \cdot \mathbf{ipd})|^2}\right)}{\left(|w_1|^2 \cdot \mathbf{iid} + |w_2|^2 + 2 \cdot \mathbf{icc} \cdot \sqrt{\mathbf{iid}} \cdot \Re\{w_1 \cdot w_2^* \cdot \exp(\mathbf{j} \cdot \mathbf{ipd})\}\right)}.$$

The previous examples have described a system which allows varying and asymmetric weights (including amplitude asymmetry between the weights) to be used with a down-mix/up-mix system without requiring any additional parameters to be communicated. Rather, the weights and the up-mix operation can be based on the parametric data.

Such an approach is particularly advantageous when the subbands used for the down-mix and up-mix corresponds relatively closely to the analysis bands for which the parameters are calculated.

This may often be the case for lower frequencies where the down-mix subbands and the parametric analysis frequency bands tend to coincide. However, in some embodiments it may be advantageous to e.g. have down-mix subbands that have a finer frequency and/or time quantization than the analysis frequency bands as this may in some scenarios result in improved audio quality. This may particularly be the case for higher frequencies.

Thus, at the higher frequency ranges, the correlation between the subbands of the down-mix and the parameter analysis may differ. As the weights may be different for the individual down-mix subbands, the correlation between the parametric data and the individual weights for each subband may be less accurate. However, the parametric data may typically be used to generate a coarser estimate of the down-mix weights, and typically the associated quality degradation will be acceptable.

Specifically, in some embodiments, the encoder may evaluate the difference between the actual down-mix weights used in each subband and those that can be calculated based on the parametric data of the wider analysis band. If the discrepancy becomes too large, the encoder may include an indication of this. Thus, the encoder may include an indication of whether the parametric data should be used to generate the weights for at least one frequency-time interval (e.g. for a down-mix subband of one segment). If the indication is that the parametric data should not be used, the encoder may instead use another approach, such as e.g. base the up-mix on an assumption of the down-mix being a simple summation.

In some embodiments, the encoder may further be arranged to include an indication of the down-mix weights used for subbands for which the accuracy indication indicates that the parametric data is insufficient to estimate the weights. In such embodiments, the decoder 115 may thus directly extract these weights and apply them to the appropriate subbands. The weights may be communicated as absolute values or may e.g. be communicated as relative values such as e.g. the difference between the actual weights and those that are calculated using the parametric data.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A decoder for generating a multi-channel audio signal, the decoder comprising:

a first receiver for receiving a down-mix signal being a combination of at least a first channel signal weighted by a first weight and a second channel signal weighted by a second weight, the first weight and the second weight having different amplitudes for at least some time-frequency intervals;

a second receiver for receiving up-mix parametric data characterizing a relationship between the first channel signal and the second channel signal;

a circuit for generating a first weight estimate for the first weight and a second weight estimate for the second weight from the up-mix parametric data; and an up-mixer for generating the multi-channel audio signal by up-mixing the down-mix signal in response to the up-mix parametric data, the first weight estimate and the second weight estimate, the up-mixing being dependent on an amplitude of at least one of the first weight estimate and the second weight estimate, wherein the up-mix parametric data comprises an accuracy indication for a relationship between the first weight and the second weight and the up-mix parametric data, and the decoder is arranged to generate at least one of the first weight estimate and the second weight estimate in response to the accuracy indication.

2. The decoder as claimed in claim 1, wherein the generating circuit is arranged to generate the first weight estimate and the second weight estimate with different relationships to at least some parameters of the parametric data for the at least some time-frequency intervals.

3. The decoder as claimed in claim 2, wherein the generating circuit is arranged to determine at least one of the first weight estimate and the second weight estimate as a function of an energy parameter of the up-mix parametric data, the energy parameter being indicative of a relative energy characteristic for the first channel signal and the second channel signal.

4. The decoder as claimed in claim 3, wherein the energy parameter is at least one of:

an Interchannel Intensity Difference, IID, parameter;

an Interchannel Level Difference, ILD, parameter; and an Interchannel Coherence/Correlation, IC/ICC, parameter.

5. A decoder for generating a multi-channel audio signal, the decoder comprising:

a first receiver for receiving a down-mix signal being a combination of at least a first channel signal weighted by a first weight and a second channel signal weighted by a second weight, the first weight and the second weight having different amplitudes for at least some time-frequency intervals;

a second receiver for receiving up-mix parametric data characterizing a relationship between the first channel signal and the second channel signal;

a circuit for generating a first weight estimate for the first weight and a second weight estimate for the second weight from the up-mix parametric data; and an up-mixer for generating the multi-channel audio signal by up-mixing the down-mix signal in response to the up-mix parametric data, the first weight estimate and the second weight estimate, the up-mixing being dependent on an amplitude of at least one of the first weight estimate and the second weight estimate, wherein at least one of the first weight and the second weight for at least one frequency interval has a finer frequency-temporal resolution than a corresponding parameter of the up-mix parametric data.

6. A decoder for generating a multi-channel audio signal, the decoder comprising:

a first receiver for receiving a down-mix signal being a combination of at least a first channel signal weighted by a first weight and a second channel signal weighted by a second weight, the first weight and the second weight having different amplitudes for at least some time-frequency intervals;

a second receiver for receiving up-mix parametric data characterizing a relationship between the first channel signal and the second channel signal;

a circuit for generating a first weight estimate for the first weight and a second weight estimate for the second weight from the up-mix parametric data; and an up-mixer for generating the multi-channel audio signal by up-mixing the down-mix signal in response to the up-mix parametric data, the first weight estimate and the second weight estimate, the up-mixing being dependent on an amplitude of at least one of the first weight estimate and the second weight estimate, wherein the up-mixer is arranged to generate an Overall Phase Difference value for the in response to the parametric data and to perform the up-mixing in response to the Overall Phase Difference value, the Overall Phase Difference value being dependent on the first weight estimate and the second weight estimate.

7. The decoder as claimed in claim 6, wherein the up-mixer performs the up-mixing independent of the amplitude of the at least one of the first weight estimate and the second weight estimate except for the Overall Phase Difference value.

8. The decoder as claimed in claim 1, wherein the up-mixer is arranged to:

generate a decorrelated signal from the down-mix signal, the decorrelated signal being decorrelated with the down-mix signal; and up-mix the down-mix signal by applying a matrix multiplication to the down-mix signal and the decorrelated signal wherein coefficients of the matrix multiplication are dependent on the first weight estimate and the second weight estimate.

9. The decoder as claimed in claim 1, wherein the up-mixer is arranged to determine the first weight estimate by:

determining a first energy measure indicative of an energy of a non-phase aligned combination for the first channel signal and the second channel signal in response to the up-mix parametric data;

determining a second energy measure indicative of an energy of a phase aligned combination of the first channel and the second channel in response to the up-mix parametric data;

determining a first measure of the first energy measure relative to the second energy measure; and determining the first weight estimate in response to the first measure.

10. The decoder as claimed in claim 1, wherein the up-mixer is arranged to determine the first weight estimate by:

for each of a plurality of pairs of predetermined values of the first weight and the second weight determining in response to the parametric data an energy measure indicative of an energy of a down-mix corresponding to the pairs of predetermined values; and determining the first weight in response to the energy measures and the pairs of predetermined values.

11. An encoder for generating an encoded representation of a multi-channel audio signal comprising at least a first channel and a second channel, the encoder comprising:

a down-mixer for generating a down-mix signal as a combination of at least a first channel signal of the first channel weighted by a first weight and a second channel signal of the second channel weighted by a second weight, the first weight and the second weight having different amplitudes for at least some time-frequency intervals;

a circuit for generating up-mix parametric data characterizing a relationship between the first channel signal and the second channel signal, the up-mix parametric data further characterizing the first weight and the second weight; and a circuit for generating the encoded representation to include the down-mix signal and the up-mix parametric data, wherein the down-mixer is arranged to:

determine a first energy measure indicative of an energy of a non-phase aligned combination for the first channel signal and the second channel signal;

determine a second energy measure indicative of an energy of a phase aligned combination of the first channel signal and the second channel signal;

determine a first measure of the first energy measure relative to the second energy measure; and determine the first weight and the second weight in response to the first measure, and wherein the up-mix parametric data comprises an accuracy indication for a relationship between the first weight and the second weight and the up-mix parametric data.

12. A method of generating a multi-channel audio signal, the method comprising:

receiving a down-mix signal being a combination of at least a first channel signal weighted by a first weight and a second channel signal weighted by a second weight, the first weight and the second weight having different amplitudes for at least some time-frequency intervals;

receiving up-mix parametric data characterizing a relationship between the first channel signal and the second channel signal;

generating a first weight estimate for the first weight and a second weight estimate for the second weight from the up-mix parametric data; and generating the multi-channel audio signal by up-mixing the down-mix signal in response to the up-mix parametric data, the first weight estimate and the second weight estimate, the up-mixing being dependent on an amplitude of at least one of the first weight estimate and the second weight estimate, wherein the up-mix parametric data comprises an accuracy indication for a relationship between the first weight and the second weight and the up-mix parametric data, and wherein in the step of generating the first and second weight estimates, at least one of the first weight estimate and the second weight estimate is generated in response to the accuracy indication.

13. A method of generating an encoded representation of a multi-channel audio signal comprising at least a first channel and a second channel, the method comprising:

generating a down-mix signal as a combination of at least a first channel signal of the first channel weighted by a first weight and a second channel signal of the second channel weighted by a second weight, the first weight and the second weight having different amplitudes for at least some time-frequency intervals;

generating up-mix parametric data characterizing a relationship between the first channel signal and the second channel signal, the up-mix parametric data further characterizing the first weight and the second weight; and generating the encoded representation to include the down-mix and the up-mix parametric data, wherein the up-mix parametric data comprises an accuracy indication for a relationship between the first weight and the second weight and the up-mix parametric data.

14. A non-transitory computer-readable storage medium encoded with a computer program having steps which, when executed on a computer, cause the computer to perform the method as claimed in claim 12.

15. A non-transitory computer-readable storage medium having stored thereon an audio bit stream for a multi-channel audio signal, said audio bit stream comprising a down-mix signal being a combination of at least a first channel signal weighted by a first weight and a second channel signal weighted by a second weight, the first weight and the second weight having different amplitudes for at least some time-frequency intervals; and up-mix parametric data characterizing a relationship between the first channel signal and the second channel signal, the up-mix parametric data further characterizing the first weight and the second weight, wherein the up-mix parametric data comprises an accuracy indication for a relationship between the first weight and the second weight and the up-mix parametric data.

* * * * *